US007189058B2

(12) United States Patent
Metz et al.

(10) Patent No.: US 7,189,058 B2
(45) Date of Patent: Mar. 13, 2007

(54) FLUID FLOW ENGINE AND SUPPORT RING FOR IT

(75) Inventors: Dietmar Metz, Meckhenheim (DE); Hans-Peter Schmalzl, Reichelsheim (DE); Ralf Boening, Reiffelbach (DE)

(73) Assignee: Borg Warner Inc., Auburn Hills, MI (US)

( * ) Notice: Subject to any disclaimer, the term of this patent is extended or adjusted under 35 U.S.C. 154(b) by 140 days.

(21) Appl. No.: 10/998,516

(22) Filed: Nov. 29, 2004

(65) Prior Publication Data

US 2006/0034684 A1 Feb. 16, 2006

(30) Foreign Application Priority Data

Nov. 28, 2003 (EP) ..... 03027266

(51) Int. Cl.
*F01D 17/16* (2006.01)

(52) U.S. Cl. ..... 415/165

(58) Field of Classification Search ..... 415/126, 415/163, 165; 60/602
See application file for complete search history.

(56) References Cited

U.S. PATENT DOCUMENTS 2,447,942 A 8/1948 Imbert
4,659,295 A 4/1987 Burdette
5,947,681 A 9/1999 Rochford
5,964,574 A 10/1999 Meier
6,314,736 B1 * 11/2001 Daudel et al. ..... 60/602
6,739,134 B2 5/2004 Fledersbacher
2005/0268610 A1 * 12/2005 Daudel et al. ..... 60/602

FOREIGN PATENT DOCUMENTS

DE 197 03 033 A 7/1998
DE 100 29 640 A 1/2002

* cited by examiner

*Primary Examiner*—Ninh H. Nguyen
(74) *Attorney, Agent, or Firm*—Akerman & Senterfitt; Stephan A. Pendorf; Greg Dziegielewski

(57) ABSTRACT

A fluid flow engine comprises a guiding grid in a housing arrangement for housing a turbine wheel. The housing arrangement has a central discharge channel for the fluid driving the turbine wheel. A ring of guiding vanes located around a central axis is mounted to a support ring round the central axis. The support ring is inserted into the housing arrangement and is fastened in an axially and a radially moveable manner to the housing arrangement by a appropriate fastening device which enables such mobility.

14 Claims, 3 Drawing Sheets

FLUID FLOW ENGINE AND SUPPORT RING FOR IT

FIELD OF THE INVENTION

The present invention relates to a fluid flow engine comprising a guiding grid in a housing arrangement which houses a turbine and includes a central discharge channel. In particular, the invention relates to such a fluid flow engine which comprises a ring of guiding vanes located around a central axis, as well as a support ring to which the ring of guiding vanes is mounted around the central axis, the support ring being inserted into the housing arrangement.

Fluid flow engines of this kind are customary designed in a variety of constructions, for example as secondary air pumps or as turbines, but particularly as turbochargers which often comprise separate housing parts for housing the turbine and its bearings, the parts being fastened to one another. Therefore, the term "housing arrangement" should be understood within the context of the present description in a manner so as to encompass either the turbine housing only or the bearing housing only or a combination of both.

BACKGROUND OF THE INVENTION

Guiding grids in fluid flow engines are subjected to various types of stress, also pulsating ones, be it by the forces of the fluid itself, be it by the influence of temperatures, or by imposed vibrations from the exterior (for example of a combustion engine). In order to mitigate or exclude these influences, guiding grids have been fastened either to a wall of the housing itself or by means of the support ring, but in all cases firmly secured to the housing, generally a turbine housing. Examples of such designs can be found, for example, in EP-B1-0 226 444 or in U.S. Pat. No. 5,146,752 where the support ring or nozzle ring is firmly clamped by threaded bolts.

The phenomenon of distortion within such a guiding grid is known to those skilled in the art. In the case of a guiding grid of variable geometry, this may lead to blockage of the moveable guiding vanes, as the above-mentioned EP-B1-0 226 444 explains. Such distortions, which usually occur in periodical intervals, will also result in fatigue of the material. This is especially disagreeable in the case of turbines which are subjected to a varying influence of high temperatures, particularly in turbochargers.

SUMMARY OF THE INVENTION

In a first step, the invention is based on the recognition that the traditional rigid attachment, even considering that it results in a desirably fixed spatial relationship of the individual parts, is disadvantageous with respect to the distortion problem. For any temperature dependent expansions of the material will forcibly lead to the abovementioned distortions, if it is rigidly mounted. However, such distortions should be avoided.

Therefore, in a second mental step, the invention comes to a construction of a fluid flow engine, as mentioned at the outset, where the nozzle ring is mounted to the housing arrangement by means of a mounting device in an axially and/or radially displaceable way.

This solution is basically amazing, and one would almost think that this cannot work. However, this is not the case, and the mounting device according to the invention absorbs all forces acting onto the guiding grid and enables, a compensation even though it may be to a small and limited extent. It has been shown that in this way malfunctions, feared up to now (vide the above-mentioned EP-B1-0 226 444), can be avoided.

This is particularly favorable if the guiding grid has a variable geometry wherein the nozzle ring is formed to support shafts or axles of moveable guiding vanes. For the phenomenon of jamming of the guiding vanes, so difficult to control up to now, is safely avoided according to the invention the same way as distortions of the nozzle ring which could also be the reason for a malfunction.

In principle, axial mobility under adaptation to prevailing temperature conditions could be effected in such a way, as is known from mounting a laser mirror of a laser resonator, i.e. on rods which expand under the influence of heat, thus holding the mirror (and in the present case it would be one of the support rings, such as the nozzle ring) at the right distance to avoid jamming of the guiding vanes. However, it is preferred if the fasting device comprises a recess extending in radial direction, particularly being situated at the radial exterior of the support ring, and preferably being formed by a groove, especially an annular groove, in the support ring, and a deepening, preferably a groove, particularly an annular groove, in a radially opposite wall of the housing arrangement, an insert (e.g. a snap ring, a piston ring or a Seeger circlip ring) being provided between the recess and the deepening in such a way that it, nevertheless, enables an axial and/or radial mobility. The reason, why this construction is preferred, resides in the fact that varying temperature is not the only influence which acts onto the guiding grid, but, as has already been mentioned, flow forces too. The preferred construction, however, enables a certain, but limited, mobility under all these influences.

BRIEF DESCRIPTION OF THE DRAWINGS

Further details of the invention will become apparent from the following description of embodiments schematically shown in the drawings, in which FIG. 1 shows a partial axial cross-section of the bearing housing and the turbine housing of a turbocharger, of which FIG. 3 is a cross-sectional view along the line III—III of FIG. 1, whereas

DETAILED DESCRIPTION OF THE DRAWINGS

Figure 1:
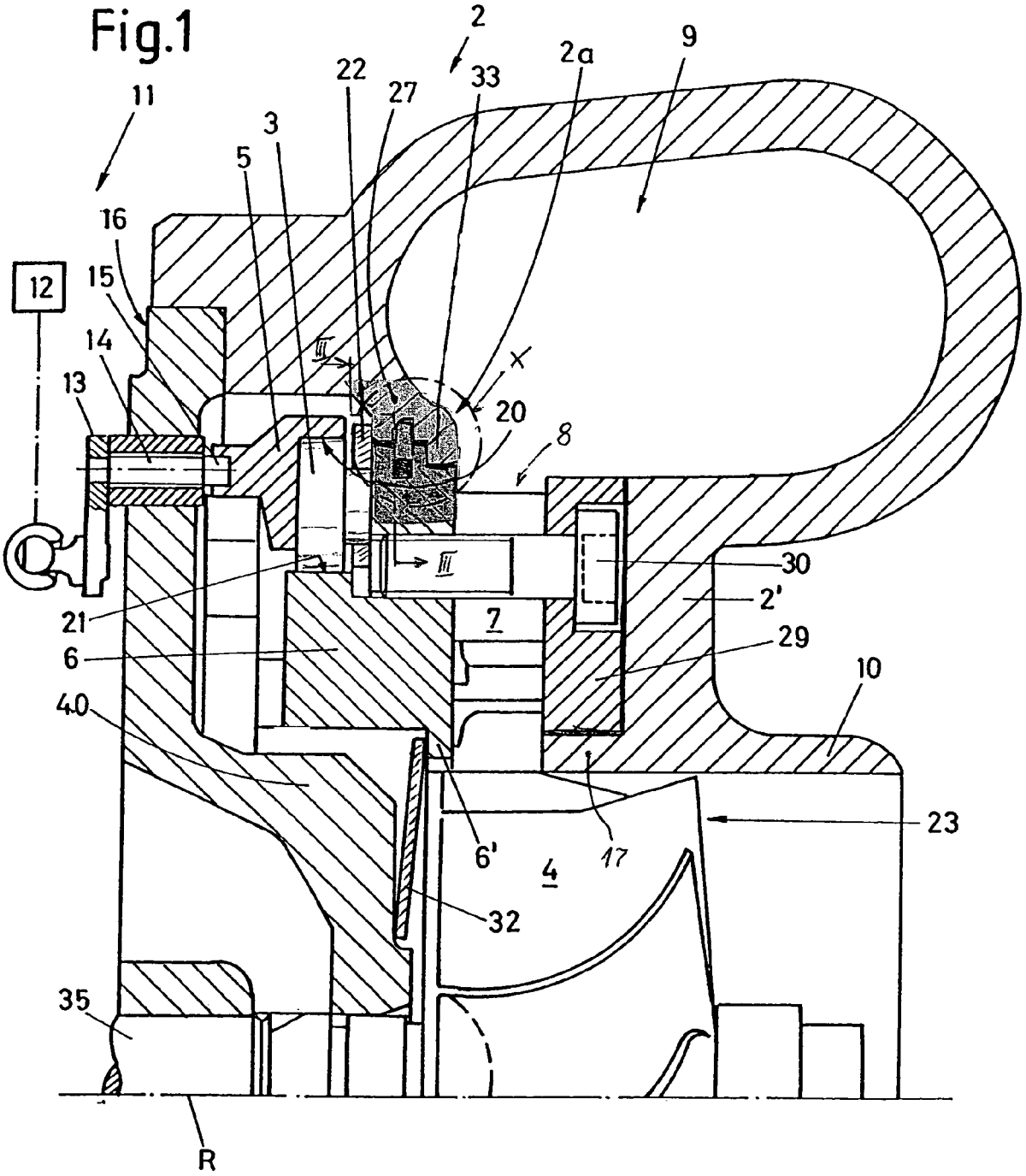

According to FIG. 1, a turbine housing 2 is connected, by means of a flange 16, to a bearing housing of which a cylindrical portion 40 projects into the turbine housing 2 and supports a shaft 35 of a turbine rotor 4. The turbine housing 2 comprises a supply channel 9 spirally surrounding the turbine rotor 4 for supplying fluid which drives the turbine rotor 4 (in the case of a turbocharger, the fluid is waste gas of a combustion engine), a rotor space 23 and an axial channel 10 through which the fluid or the waste gas is discharged.

In order to supply a controlled amount of fluid to the turbine rotor 4, an arrangement is provided at the exit side of the supply channel 9 and before the rotor space 23 which is known to those skilled in the art under the term "guiding grid of variable geometry". This guiding grid comprises substantially a ring of moveable guiding vanes 7 concentrically surrounding the turbine rotor 4, whose adjustment shafts (or alternatively axles) rigidly connected to them are supported by a support ring 6 which surrounds coaxially the turbine rotor 4 and, in the case of a turbocharger, is known to those skilled in the art under the term "nozzle ring".

Pivoting or adjustment of the adjustment shafts may be effected in the manner known from U.S. Pat. No. 4,659,295 where an actuation device 11 includes a control housing 12 which controls the control movement of a tappet element mounted to it (illustrated merely in dash-dotted lines in FIG. 1) whose movement is converted, via an actuation lever 13, an actuation shaft 14 connected thereto and, for example, via an eccentric 15 engaging an opening of a unison ring 5 behind the nozzle ring 6, into a slight rotational movement of the unison ring 5 about a central axis R.

By this slight rotational movement of the unison ring 5, the pivot positions of the guiding vanes 7 are adjusted relative to the turbine rotor 4 in a manner known per se which is such that the guiding vanes 7 are displaced from an about tangentially extending extreme position into an about radially extending other extreme position. In this way, a greater or smaller amount of waste gas of a combustion motor, supplied through the supply channel 9, is fed to the turbine rotor 4 prior to being discharged through the axial channel 10 which extends along the axis of rotation R.

Constructions, as described above, are in principle known. In an older patent application assigned to the same assignee as the present one, it is suggested to let the unison ring 5 roll by means of rollers 3 held by a cage ring 22 between a bearing surface 20 of the unison ring 5 and a shoulder 21 of the support or nozzle ring 6, thus facilitating movement. In order to be able to mount the guiding grid as a modular unit into the turbine housing 2, i.e. to enable premounting it and fastening it to the turbine housing 2 or, for example, to the cylindrical portion 40 of the bearing housing, it is preferred to provide a releasably connectable mounting ring 29 which, together with the nozzle ring 6, delimits a vane space 8 where the guiding vanes 7 are supported, the corresponding axial distance being given by spacers known in the art.

As may be further seen in FIG. 1, the mounting ring 29, which may also be called a support ring according to the invention, is shifted onto an annular shoulder 17 of a wall 2' of the turbine housing 2, and is optionally screwed to it, or, alternatively is only placed on it leaving a slight play to enable it to shift in axial direction. A Belleville spring washer or a heat shield 32 may engage an inner flange 6' of the nozzle ring 6 to hold the guiding grid in axial direction and to press it against the wall 2'. The other radial end of the Belleville spring washer 32 engages the cylindrical portion 40 of the bearing housing. As mentioned before, the mounting ring 29 may also have a small play in axial direction relative to the wall 2'.

While a Belleville spring washer 32 is optionally provided to bias the nozzle ring 6 at a radial inner projection 6', the nozzle ring 6, according to the invention, is fastened in such a way that a slight mobility in radial and/or axial direction is enabled. This shall be described now with reference to FIG. 2 which represents the detail X of FIG. 1 at a larger scale. Fastening, in the embodiment shown, is effected at the radial outer side of the nozzle ring 6 to a forked wall portion 27 of the turbine housing 2 (as it is preferred), but could also be effected at the radial inner side of the bearing housing, for example at the cylindrical portion 40 thereof.

Figure 2:
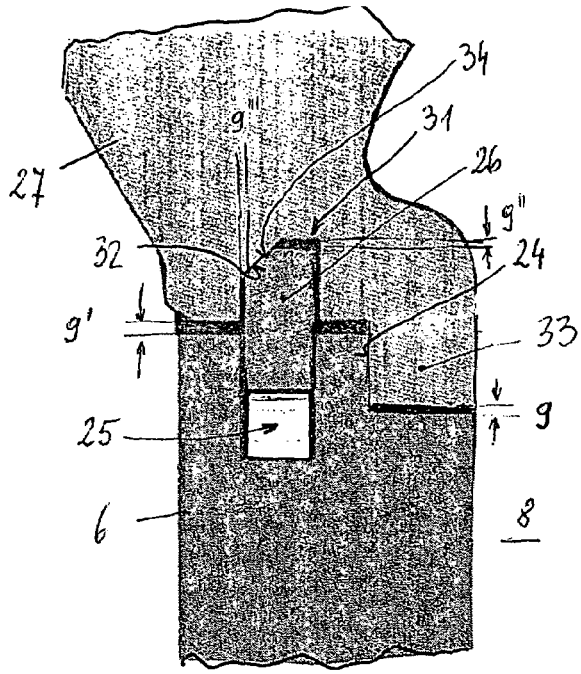
FIG. 2 illustrates detail X of FIG. 1 at a larger scale.

FIG. 2 shows the situation in detail. The nozzle ring 6 has a portion of smaller diameter that faces the vane space 8 (at right in FIG. 2), which portion is enabled to pass with a small play g below an annular projection 33. The radial play g serves to enable a radial expansion of the nozzle ring 6. Another portion of the nozzle ring 6, which is averted from the vane space 8 (at left in FIG. 2), has a larger diameter and presents the same play g' or a play different from play g which serves the same purpose. In this way, radial mobility due to thermal expansions is unimpededly enabled.

As a supplement to the Belleville spring washer 32 (FIG. 1) or even without that, a type of attachement is provided for the nozzle ring 6 which, on the one hand, does not impede a radial mobility thereof, but on the other hand biases the nozzle ring 6 against a shoulder surface 24 formed by the projection 33. Theoretically, the arrangement could also be reversed so that the shoulder surface 24 and the projection are situated at the side averted from the vane space 8 and biasing is effected away from the vane space 8, but this is less preferred.

For the purpose of such an attachment which enables limited mobility, a radially extending recess 25 is provided in the portion of larger diameter of the nozzle ring 6. This recess 25 could be formed as an individual indentation (in this case, a plurality of such indentations would be distributed over the circumference of the nozzle ring), but for production reasons and also for facilitating mounting, the recess 25 is formed as a groove, and particularly as an annular groove. In the present particularly preferred embodiment, it is an annular groove 25, an elastic ring 26 being inserted whose elasticity may result, for example, from corrugations, but which is preferably formed as a snap ring, a piston ring or a Seeger circlip ring and has an open disconnecting point 28 (FIG. 3) so that the spreading ends of the ring 26 at this disconnecting point 28 may elastically be pressed together to reduce its diameter. To this end, the radial depth of the groove 25 is suitably dimensioned such that it may receive in compressed condition of the ring 26, at least approximately, its entire radial width (optionally minus the play g').

The elastic ring 26 inserted, again with a certain play, into this groove 25 projects into a groove 31 opposite the groove 25, the groove 31 causing a fork-shaped cross-section of the radially inwards protruding wall 27. It will be understood that, in case there are mere indentations distributed over the circumference of the nozzle ring 6 which receive each an insert (having the cross-section of the ring 26), also this groove 31 could be formed by individual indentations or recesses, however, that a groove or annular groove is preferred. In order to bias the nozzle ring 6 towards the shoulder surface 24, it is advantageous if the groove 31 and/or the ring 26 comprises an inclined surface 32' (of the groove 31) and/or a tapering surface 34 (of the ring 26), as may be seen in FIG. 2.

By mutual engagement of the tapering surface 34 and the inclined surface 32', the spring force of the ring 26, which presses in radial direction to the exterior, will result in an axial component by which the nozzle ring 6 is biased against the shoulder surface 24, as illustrated. The fact that the ring 26 possesses a radial play g" and an axial play g'" permits a certain mobility in both directions which may also serve to compensate for production tolerances. However, it will be understood that the said axial component would also be created if only one of the parts 26 and 31 had an inclined surface 32' or a tapering surface 34. But in each case, it is possible, that the nozzle ring 6, upon thermal expansion or any other tendency of a distortion, has both the possibility of a radial expansion and of an axial movement. In the former case, the thermal expansion would be absorbed by the play g', in the latter case by the axial play g'", wherein the tapering surface 34 of the ring 26 shifts along the inclined surface 32'.

Figure 3:
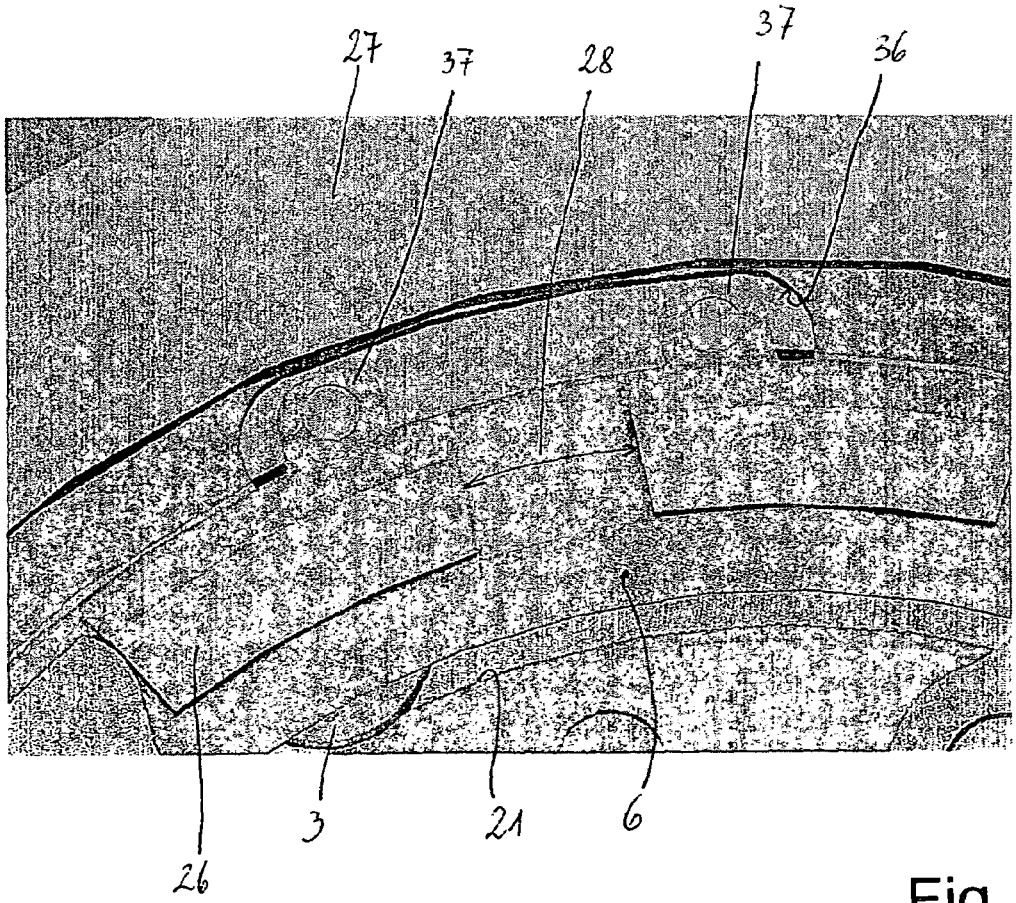

When viewing the arrangement of FIG. 2, the question may be raised how mounting could be effected with a ring 26 which engages two opposite grooves 25 and 31. Of course, it would be possible, just due to the existence of the axial play g', to press the ring 26 into the groove 25 and to shift then the nozzle ring 6 below the wall 27. However, it is more favorable to provide the ring 26 with at least one mounting dog in order to be able to make the disconnecting point 28 smaller by means of a tool. Such a mounting dog could be formed by a projection or by a lug or other opening, but it is preferred if at least one of the mounting dogs, preferably both, is provided as a lug 37, which, in particular, is integrally formed (FIG. 3). These lugs 37, according to the illustration of FIG. 3, are formed at the upper side of the ring 26 at both ends of the disconnecting point 28, but could optionally also protrude laterally in axial direction. The lugs 37 are preferably integrally formed by being stamped in common, although it would be possible, in theory, to weld or solder them to the ring (which could, in some cases, affect the elasticity of the ring 26).

When mounting, one presses the two lugs 37 against each other, e.g. by means of pincers, so that the distance between the ends of the disconnecting point 28 becomes at least made smaller or are even closed. In this manner, the diameter of the ring 26 is reduced and the ring 26 penetrates into the interior of the groove 25 (FIG. 2). To have a better access to the lugs 37, the left-hand delimiting wall of the groove 31 (with reference to FIG. 2) comprises an axial slot opening 36 for having access for a mounting tool, such as pincers, to the lugs 37.

Figure 4:
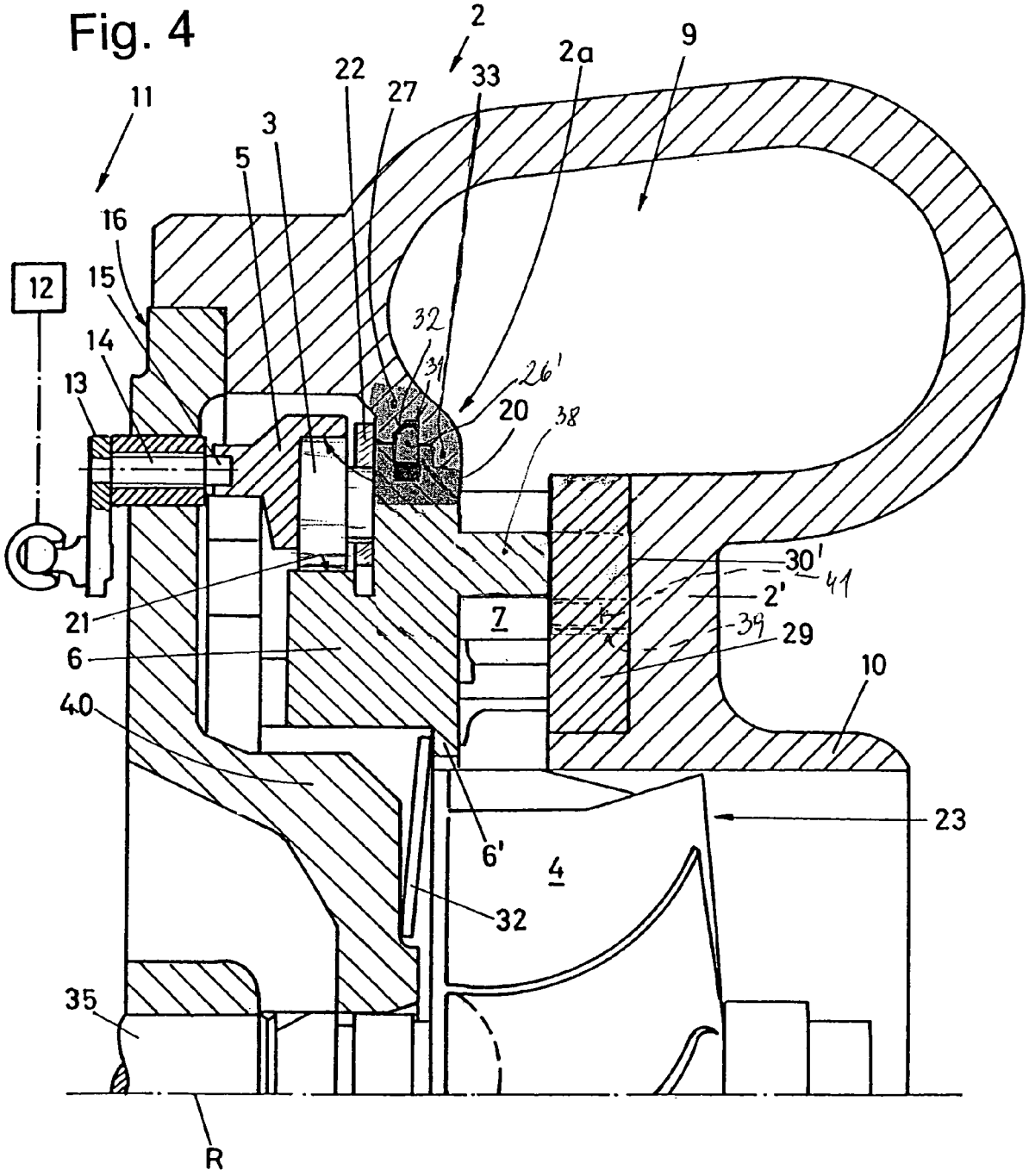
FIG. 4 represents a modified embodiment in a view similar to that of FIG. 1.

In the case of FIG. 4, although the inclined surface 32' of the groove 31 is still present, the ring 26' does not have a tapering surface, but is rounded at its radial circumference. While the two support rings, i.e. the nozzle ring 6 and the mounting ring 29, have been interconnected by threaded bolts in the embodiment of FIG. 1, this is not the case in the embodiment of FIG. 4. In this embodiment, a spacer 38 for maintaining a certain minimum distance is integrally formed on the nozzle ring 6, the spacer 38 engaging either the mounting ring 30' or directly the wall 2' of the turbine housing 2 under the axial force component imposed by the elastic ring 26. In the case of any expansion or deformation in axial direction which could affect the free movement of the guiding vanes 7, the spacer 38 is disengaged from the opposite surface (of the ring 30' or of the wall 2'), the elastic ring 26' permitting such yielding by gliding along the inclined surface 32'.

It will be understood that, since the spacer 38 does no longer has to be penetrated by a fastening screw according to the invention, this spacer 38 may be formed in a favorable way for the fluid flow and very thin, for example having a streamlined profile similar to that of an airplane in the direction from the supply channel 9 to the axis of rotation R so that only small losses of flow energy of the fluid fed to the turbine 4 have to be expected.

It is also possible to deepen the surface of the mounting ring 30' opposite the spacer 38 so that any axial movement is guided. On the other hand, the mounting ring 30' may be provided with bores 39 (shown in dotted lines) to support there axles 41 of the guiding vanes 7. In this way, supporting the vanes 7 is not deteriorated even if a (limited) axial movement of the nozzle ring 6 relative to the mounting ring 30' resulted from distortions or expansions. Nevertheless, the nozzle ring 6 together with the ring of vanes 7 and the mounting ring 30' put on them may be inserted into the turbine housing 2 in a pre-mounted condition, a particular play relative to the annular shoulder 17 being no longer necessary in this case under all circumstances.

One aspect of the embodiments according to the invention, including the opposite grooves 25, 31 and the bridging ring 26 has not yet been mentioned, i.e. the fact that the ring 26 provides also an excellent seal. For, since the tapering surface 34 (as preferred, but optionally also with a rounded edge, as in FIG. 4) of the ring 26 (FIG. 2) engages under force the inclined surface 32', it closes virtually in a hermetic fashion the path for exiting gases, whereas the relative deep groove 25 together with the engaging portion of the ring 26 forms a labyrinth seal.

Numerous variants are imaginable within the scope of the invention; for example, the invention could also be applied to guiding vanes of a constant geometry. Just in the case of FIG. 4, it would be possible to do without an inclined surface in the groove 31 or without a tapering surface, and to provide a biasing force only by the Belleville spring washer 32 mentioned before. On the other hand, one could do without the Belleville spring washer 32, if only at least one of the inclined surface 32' or the tapering surface 34 is present.

In the claims:

1. A fluid flow engine comprising:

a housing having an exit channel;

a turbine in the housing;

a guiding grid in the housing and having a ring of guiding vanes around an axis; and a support ring to which the ring of guiding vanes is mounted round the axis, the support ring being inserted into the housing, wherein the support ring is fastened to the housing by a fastening device that allows movement of the support ring in a radial direction, wherein the fastening device comprises a recess in a radially outer wall of the support ring, a groove in a radial opposite wall of the housing, and an insert between the recess and the groove to allow for movement of the support ring in the radial direction, wherein the insert has a radial outer tapering surface for engaging the groove, and wherein the groove has an inclined surface for engaging the insert.

2. The fluid flow engine of claim 1, wherein the guiding grid is of a variable geometry.

3. The fluid flow engine of claim 2, wherein the ring of guiding vanes each have axles, and wherein the support ring is a nozzle ring for supporting the axles of the ring of guiding vanes.

4. The fluid flow engine of claim 3, further comprising a mounting ring opposite the nozzle ring, wherein the ring of guiding vanes are supported between the nozzle ring and the mounting ring.

5. A fluid flow engine comprising:

a housing having an exit channel;

a turbine in the housing;

a guiding grid in the housing and having a ring of guiding vanes around an axis; and a support ring to which the ring of guiding vanes is mounted round the axis, the support ring being inserted into the housing, wherein the support ring is fastened to the housing by a fastening device, wherein the fastening device allows movement of the support ring in at least one of a radial or axial direction, wherein the housing comprises an abutment surface, wherein the fastening device comprises a biasing element for the support ring against the abutment surface, and wherein the fastening device biases the support ring towards the guiding grid.

6. The fluid flow engine of claim 5, wherein the fastening device comprises a recess in a radially outer wall of the support ring, a groove in a radial opposite wall of the housing, and an insert between the recess and the groove to allow for movement of the support ring in at least one of the radial or axial direction.

7. The fluid flow engine of claim 6, wherein the recess is an annular recess.

8. The fluid flow engine of claim 7, wherein the groove is an annular groove.

9. The fluid flow engine of claim 8, wherein the insert is an elastic ring inserted into the annular groove, and wherein the elastic ring has a radial outer tapering surface for engaging the annular groove.

10. The fluid flow engine of claim 9, wherein the annular groove has an inclined surface for engaging the elastic ring.

11. The fluid flow engine of claim 9, wherein the elastic ring comprises at least one mounting dog and wherein the groove comprises an axial slot opening for access of a mounting tool to the mounting dog.

12. The fluid flow engine of claim 6, wherein a gap is provided in between at least one of the support ring and the radial opposite wall of the housing or the insert and the recess.

13. The fluid flow engine of claim 6, wherein the insert is an elastic ring having a disconnecting point, wherein at least one mounting dog for compressing the elastic ring is at both ends of the disconnecting point.

14. The fluid flow engine of claim 13, wherein the at least one mounting dog is a lug.

* * * * *